US010039378B2

(12) United States Patent
Chang

(10) Patent No.: US 10,039,378 B2
(45) Date of Patent: Aug. 7, 2018

(54) ADJUSTABLE TABLE

(71) Applicant: Product Depot International Corp., Taichung (TW)

(72) Inventor: Chien-Kuo Chang, Taichung (TW)

(73) Assignee: PRODUCT DEPOT INTERNATIONAL CORP., Taichung (TW)

( * ) Notice: Subject to any disclaimer, the term of this patent is extended or adjusted under 35 U.S.C. 154(b) by 0 days.

(21) Appl. No.: 15/360,619

(22) Filed: Nov. 23, 2016

(65) Prior Publication Data

US 2018/0140090 A1 May 24, 2018

(51) Int. Cl.

| | |
|---|---|
| ***A47B 27/18*** | (2006.01) |
| ***A47B 13/08*** | (2006.01) |
| ***A47B 9/00*** | (2006.01) |
| ***A47B 27/02*** | (2006.01) |
| ***A47B 21/02*** | (2006.01) |
| ***A47B 13/12*** | (2006.01) |

(52) U.S. Cl.

CPC ..... *A47B 27/18* (2013.01); *A47B 9/00* (2013.01); *A47B 13/081* (2013.01); *A47B 13/12* (2013.01); *A47B 21/02* (2013.01); *A47B 27/02* (2013.01); *A47B 2200/0042* (2013.01); *A47B 2200/0043* (2013.01)

(58) Field of Classification Search

CPC ..... A47B 27/00; A47B 27/14; A47B 27/16; A47B 27/18; A47B 41/00; A47B 41/02; A47B 41/04; A47B 41/06; A47B 9/06; A47B 2013/006; A47B 2013/085; A47B 2009/009; A47B 2013/065; A47B 2013/185; A47B 2200/0012; A47B 2200/0015; A47B 2200/0011; A47B 2200/0035; A47B 2200/0041; A47B 2200/0042; A47B 2200/0043; A47B 2200/0044; B66F 7/0683

See application file for complete search history.

(56) References Cited

U.S. PATENT DOCUMENTS

| | | | | | |
|---|---|---|---|---|---|
| 2,452,216 | A * | 10/1948 | Yarber | A47B 27/18 | 108/6 |
| 3,494,306 | A * | 2/1970 | Aguilar | A47B 17/02 | 108/138 |
| 4,248,161 | A * | 2/1981 | Adair | A47B 27/02 | 108/6 |

(Continued)

FOREIGN PATENT DOCUMENTS

| | | | | |
|---|---|---|---|---|
| DE | 2638603 | A1 * | 3/1978 | A47B 41/02 |

*Primary Examiner* — Jose V Chen

(74) *Attorney, Agent, or Firm* — WPAT, PC

(57) ABSTRACT

An adjustable table includes a table board, an inclining structure, a supporting structure, and a foot structure. The table board is provided with a pivoting portion on one end thereof. The inclining structure is provided with a mounting portion on one end thereof, and the mounting portion is pivotally combined with the pivoting portion of the table board, such that the table board and the inclining structure pivotally sway to open and close. The supporting structure is combined between the table board and the inclining structure for supporting and fixing the table board and the inclining structure. The foot structure is pivotally combined with the inclining structure, such that the inclining structure sways toward the foot structure.

9 Claims, 7 Drawing Sheets

(56) References Cited

U.S. PATENT DOCUMENTS

| | | | | | |
|---|---|---|---|---|---|
| 4,383,486 | A * | 5/1983 | Reineman | A47B 9/00 | 108/10 |
| 5,088,802 | A * | 2/1992 | House | A47B 97/04 | 108/6 |
| 5,400,720 | A * | 3/1995 | Stevens | A47B 9/16 | 108/147 |
| 5,601,014 | A * | 2/1997 | Stevens | B65G 65/23 | 108/7 |
| 6,019,050 | A * | 2/2000 | Ranta | A47B 3/0911 | 108/115 |
| 8,967,579 | B2 * | 3/2015 | Tsai | A47B 27/18 | 248/188.1 |
| 9,301,599 | B1 * | 4/2016 | Ritchie | A47B 23/042 | |
| 9,635,929 | B1 * | 5/2017 | Wu | A47B 9/16 | |
| 2013/0263762 | A1 * | 10/2013 | Chang | A47B 17/00 | 108/2 |
| 2017/0251807 | A1 * | 9/2017 | Haskins | A47B 23/002 | |
| 2017/0290415 | A1 * | 10/2017 | Hsu | A47B 13/081 | |

* cited by examiner

ADJUSTABLE TABLE

BACKGROUND OF THE INVENTION

1. Field of the Invention

The present invention relates to adjustable tables, and more particularly, to an adjustable table provided with adjustable inclined angle and table height.

2. Description of the Related Art

Tables and chairs are commonly applied by people for various purposes. For example, a table and at least a chair are usually required for facilitating demands of dining, document processing, computer exploiting, or office operation. In addition, the time of people applying tables and chairs is relatively long nowadays. In case the height of the table and the chair mismatches the body shape of the user, the user might feel body pain or limbs ache after using the table and chair for a long period. Therefore, sizes of the table and chair are in direct relation to the body shape of the user.

However, most of the tables presently available are provided with a fixed side, so that the size is not able to be adjusted based on different users demand, failing to meet the ergonomics. Also, regarding to a recently provided adjustable table, one of the inclined angle and the table height is able to be adjusted; however, such adjustable tables are only able to partially resolve the issue for the user, with other disadvantages and inconveniences remaining to be improved.

Therefore, an adjustable provided with an adjustable inclined angle and table height is needed for meeting the demand of users with different body shapes.

SUMMARY OF THE INVENTION

For improving the issues above, an embodiment of the present invention discloses an adjustable table provided with a table board and an inclining structure. The table board and the inclining structure are pivotally disposed with each other, such that the table board and the inclining structure pivot to open and close. Also, a support structure is disposed between the table board and the inclining structure for supporting the table board and the inclining structure. In addition, the inclining structure is pivotally positioned against the foot structure of the table, such that the inclining structure inclines and sways toward the foot structure, so that the table board is able to be raised in relation to the floor, enhancing the utility of the present invention.

For achieving the aforementioned objectives, an embodiment of the present invention provides an adjustable table, comprising:

a table board provided with a pivoting portion on one end thereof;

an inclining structure provided with a mounting portion on one end thereof, the mounting portion pivotally combined with the pivoting portion of the table board, such that the table board and the inclining structure pivotally sway to open and close;

a supporting structure combined between the table board and the inclining structure for supporting and fixing the table board and the inclining structure; and a foot structure pivotally combined with the inclining structure, such that the inclining structure sways toward the foot structure.

With such configuration, the table provided by the present invention enables the user to adjust the table according to different user demand. The table board is able to be raised upward to meet the comfort requirement during operation or office work. Also, the inclining structure is able to be adjusted to incline downward toward the foot structure according to the height of the user, such that the table height against is increased against the floor, facilitating the usage convenience for a sitting or standing user. Therefore, the utility of the present invention is enhanced.

DETAILED DESCRIPTION OF THE INVENTION

Figure 1:
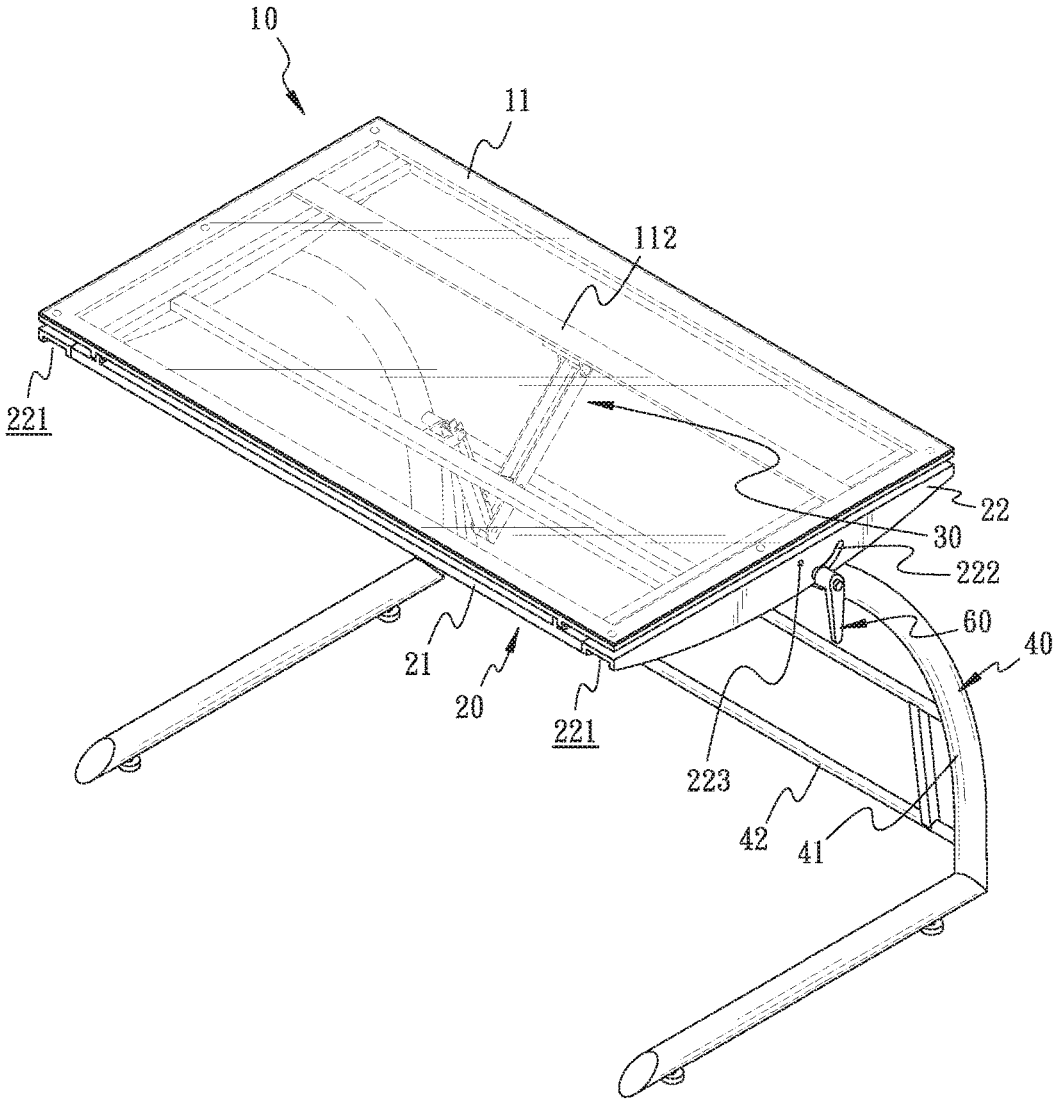
FIG. 1 is a perspective view of the adjustable table in accordance with an embodiment of the present invention.
Figure 2:
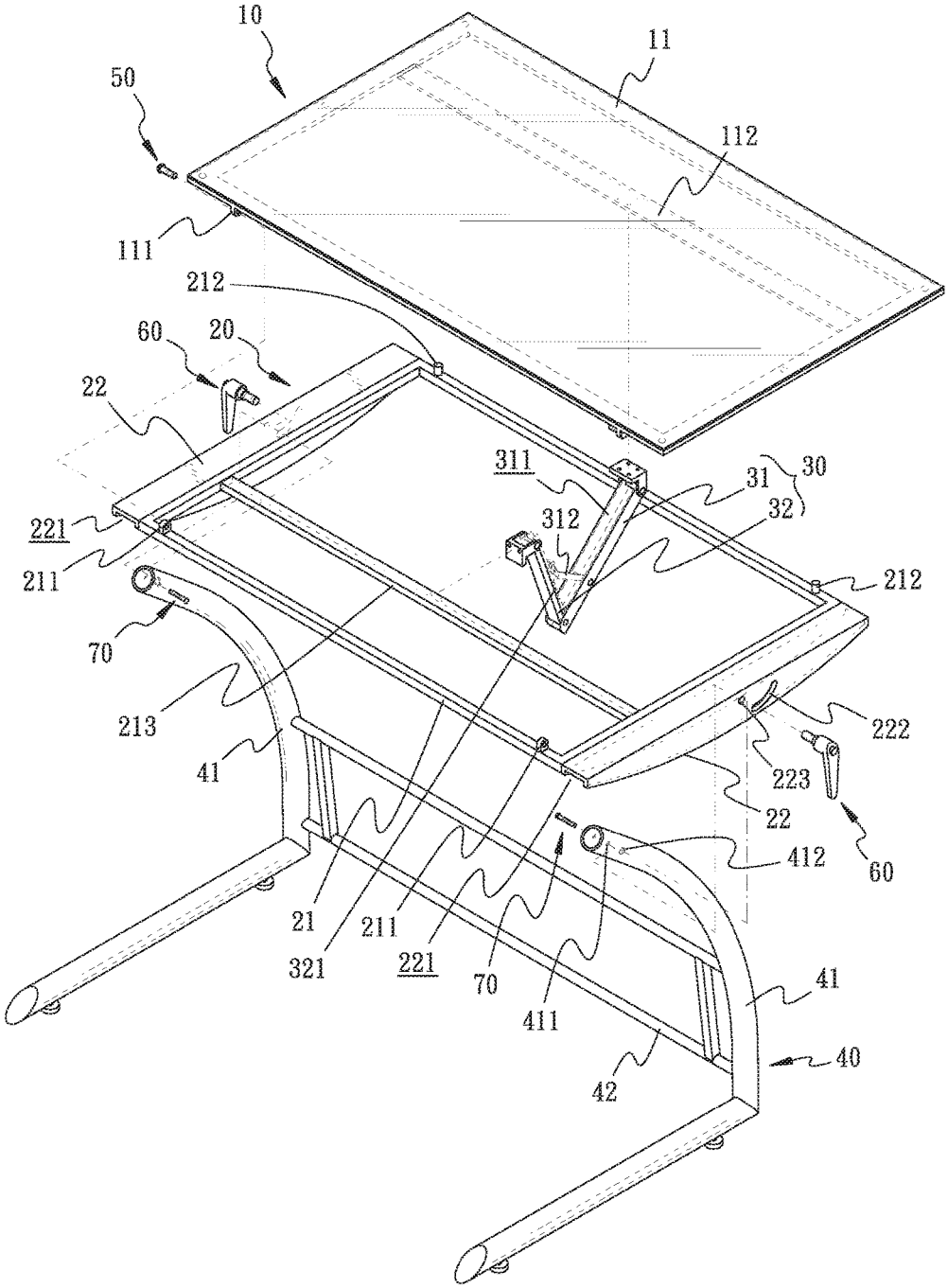
FIG. 2 is an exploded view of the adjustable table in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 7, an embodiment of the present invention provides an adjustable table, comprising a table board 10, an inclining structure 20, a supporting structure 30, and a foot structure 40. The table board 10 is pivotally combined with the inclining structure 20, and the inclining structure 20 is pivotally combined with the foot structure 40, wherein the supporting structure 30 is disposed between the table board 10 and the inclining structure 20 for supporting and fixing the table board 10 and the inclining structure 20. Therefore, the inclined angle of the table board 10 and the overall height of the table are allowed to be adjusted.

The table board 10 is formed in a rectangular shape and allowed to be made of glass, wood, or plastic. A rectangular swaying frame 11 protrudes around the periphery of one side of the table board 10, with one side of the swaying frame 11 provided with a pivoting portion 111. In an embodiment of the present invention, the pivoting portion 111 includes two pivoting holes. Also, a first dispose shaft 112 is disposed between the two short edges of the swaying frame 11. The table board 10 is able to be applied as the table board 10 of a desk, an office table, or drawing table.

The inclining structure 20 comprises a rectangular fixed frame 21 and two inclining racks 22, wherein the two inclining racks 22 are combined to the two lateral sides of the fixed frame 21, respectively. In an embodiment of the present invention, the bottom side of the two inclining racks 22 are provided with a reversed U-shape recess 221 for matching and combining the foot structure 40. The fixed frame 21 and the two inclining racks 22 are allowed to be integrally formed, screwed, or adhered with each other. In an embodiment of the present invention, the fixed frame 21 and the two inclining racks 22 are screwed by use of bolts.

Figure 4:
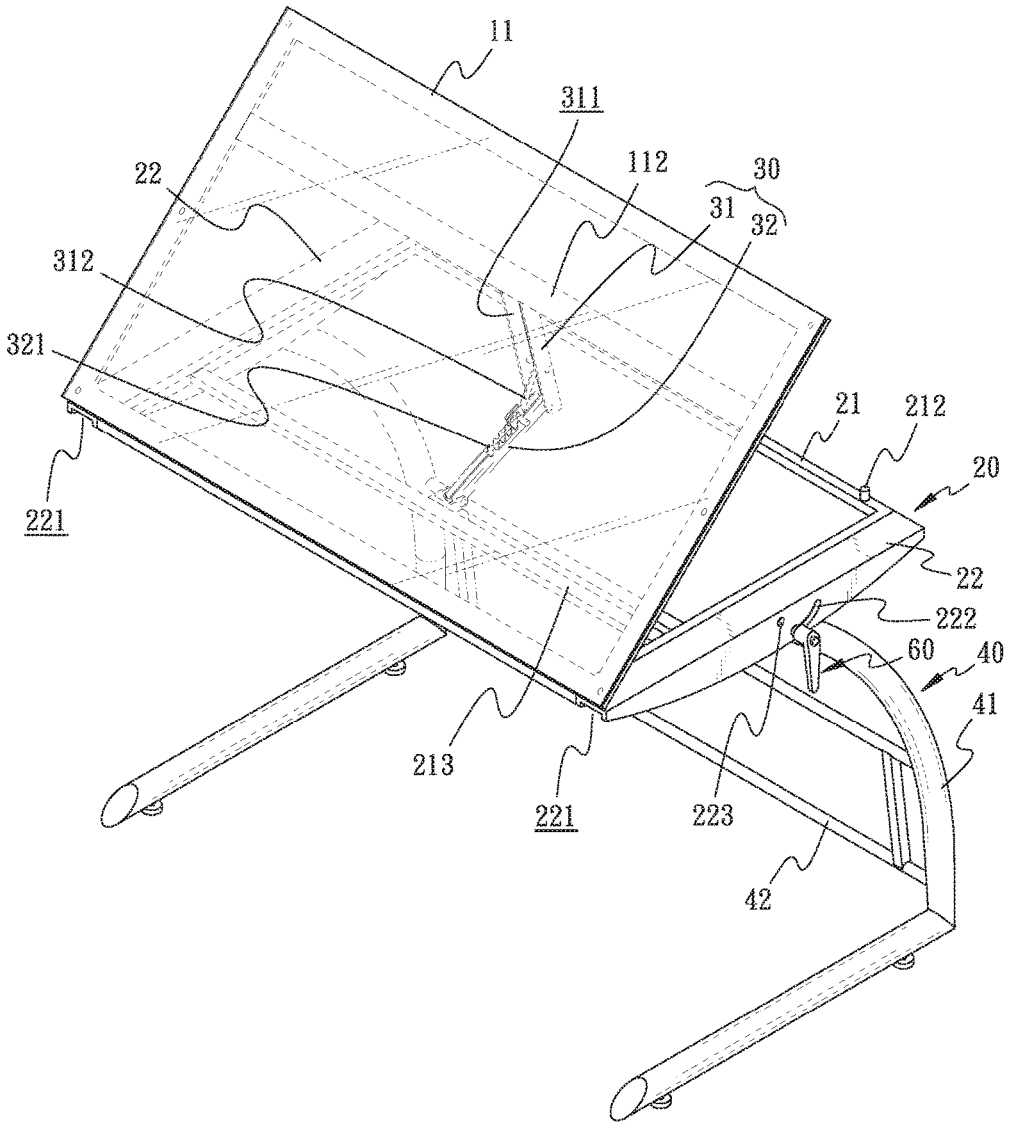
FIG. 4 is a schematic view illustrating the operation status of the adjustable table in accordance with an embodiment of the present invention; the table board is raised upward against the fixed frame.
Figure 5:
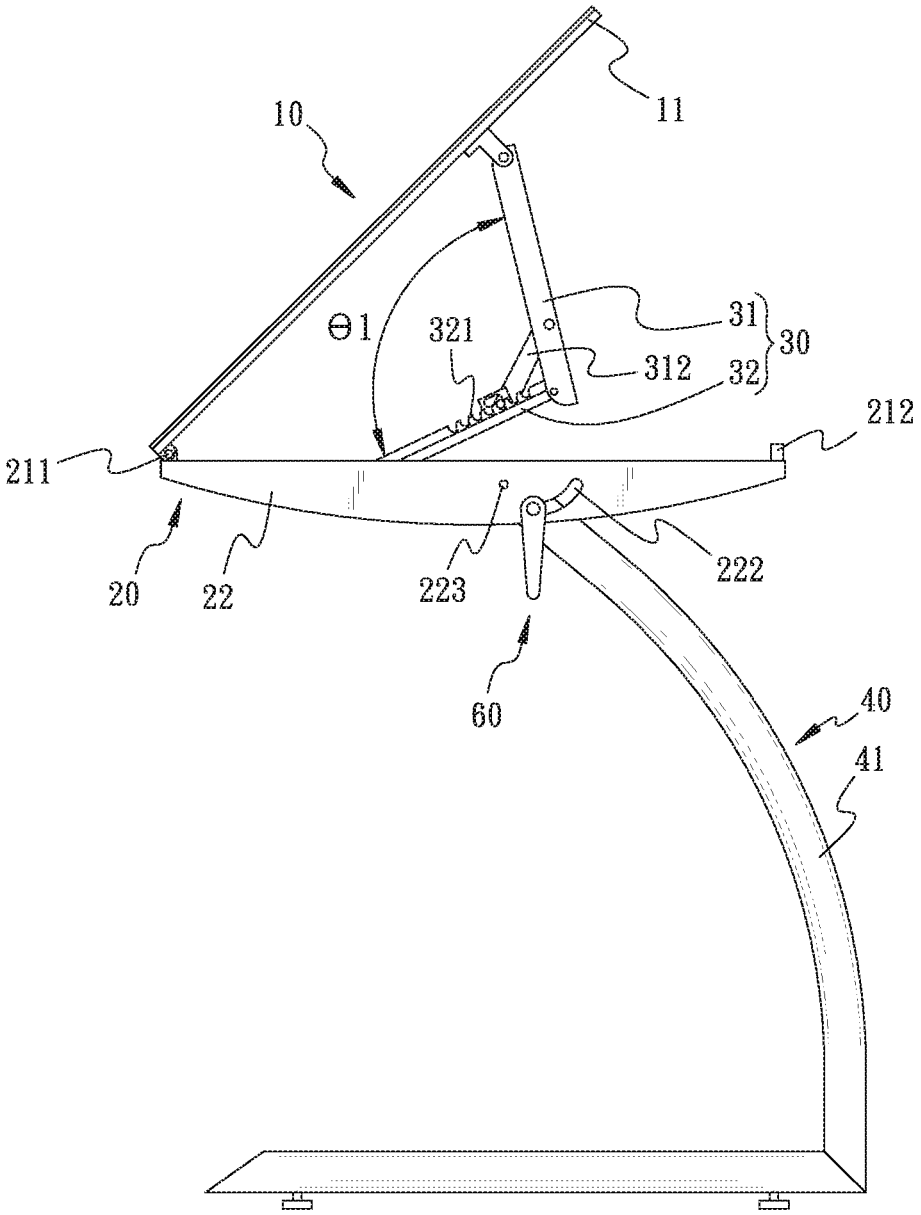
FIG. 5 is a side view of FIG. 4.

In addition, the fixed frame 21 includes a mounting portion 211, two protrusions 212, and a second dispose shaft 213. The mounting portion 211 is disposed on one side of the fixed frame 21. The mounting portion 211 is formed of two protruding holes, with two pivot members 50 passing through the mounting portion 211 and the pivoting portion 111, respectively, as shown by FIG. 4 and FIG. 5, such that the table board 10 pivots to open and close against the inclining structure 20. The two protrusions 212 are disposed on another side of the fixed frame 21 away from the mounting portion 211; also, the two protrusions 212 are disposed adjacent to two side angles of the fixed frame 21, so that the swaying frame 11 is stably placed upon the protrusions 212. The second dispose shaft 213 is disposed between the two short edges of the fixed frame 21, wherein the first dispose shaft 112 is arranged in parallel to the second dispose shaft 213.

Furthermore, one lateral side of each inclining rack 22 is provided with an engaging groove 222 and a through hole 223. The engaging groove 222 is formed in an arc shape. In an embodiment of the present invention, the engaging groove 222 extends upward from the bottom end of the inclining rack 22 toward the protrusion 212.

Figure 3:
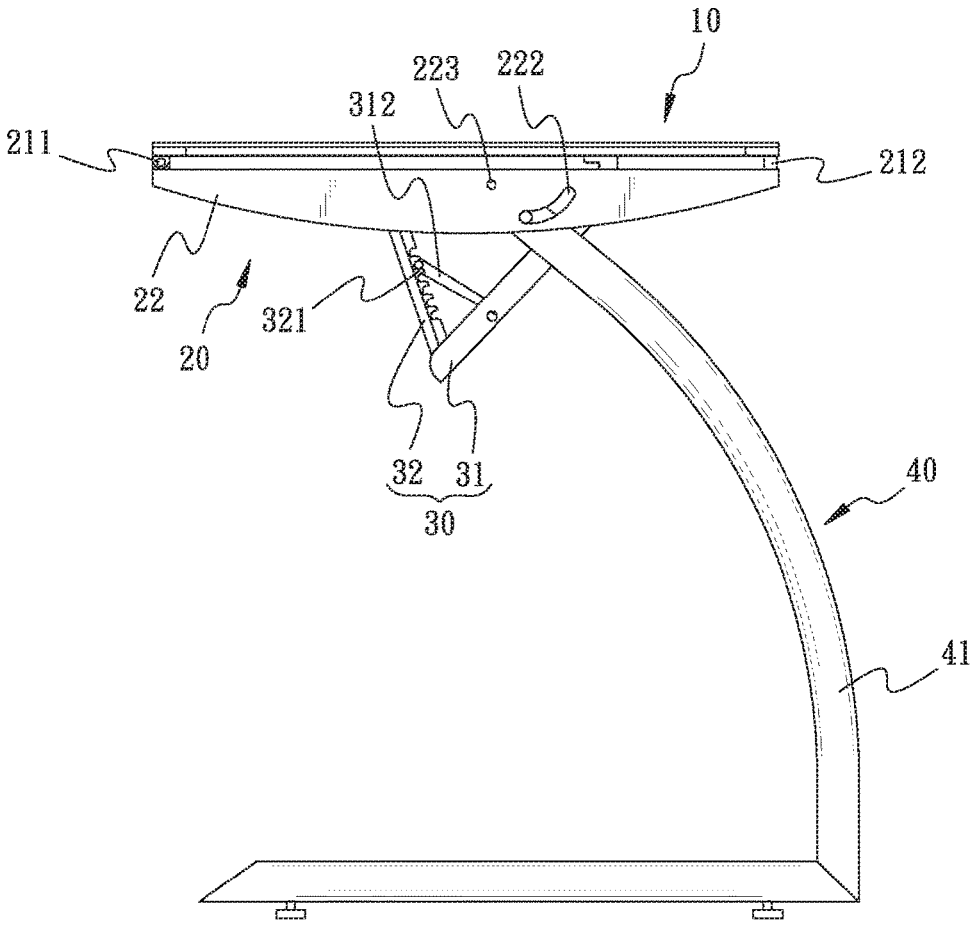
FIG. 3 is a side view of FIG. 1.

The supporting structure 30 includes a supporting shaft 31 and an adjusting shaft 32. One end of the supporting shaft 31 is disposed in the middle of the first dispose shaft 112 of the table board 10; the other end of the supporting shaft 31 is pivotally connected with one end of the adjusting shaft 32; and the other end of the adjusting shaft 32 is pivotally disposed in the middle of the second dispose shaft 213 of the inclining structure 20. The supporting shaft 31 includes a dispose groove 311 in where an elongate supporting unit 312 is pivotally disposed. The adjusting shaft 32 is provided with plural tooth-shaped scale units 321. The supporting unit 312 is optionally engaged with the scale unit 321 for fixing and supporting the table board 10 and the inclining structure 20 at different angles, such that the supporting structure 30 includes a supporting angle θ1, as shown by FIG. 3 to FIG. 5. When the table board 10 and the inclining structure 20 move toward each other to close, the supporting angle θ1 of the supporting structure 30 is 30 degrees; when the table board 10 and the inclining structure 20 move away from each other to open, the supporting angle θ1 is between 30 to 150 degrees, preferably between 30 to 120 degrees.

Figure 6:
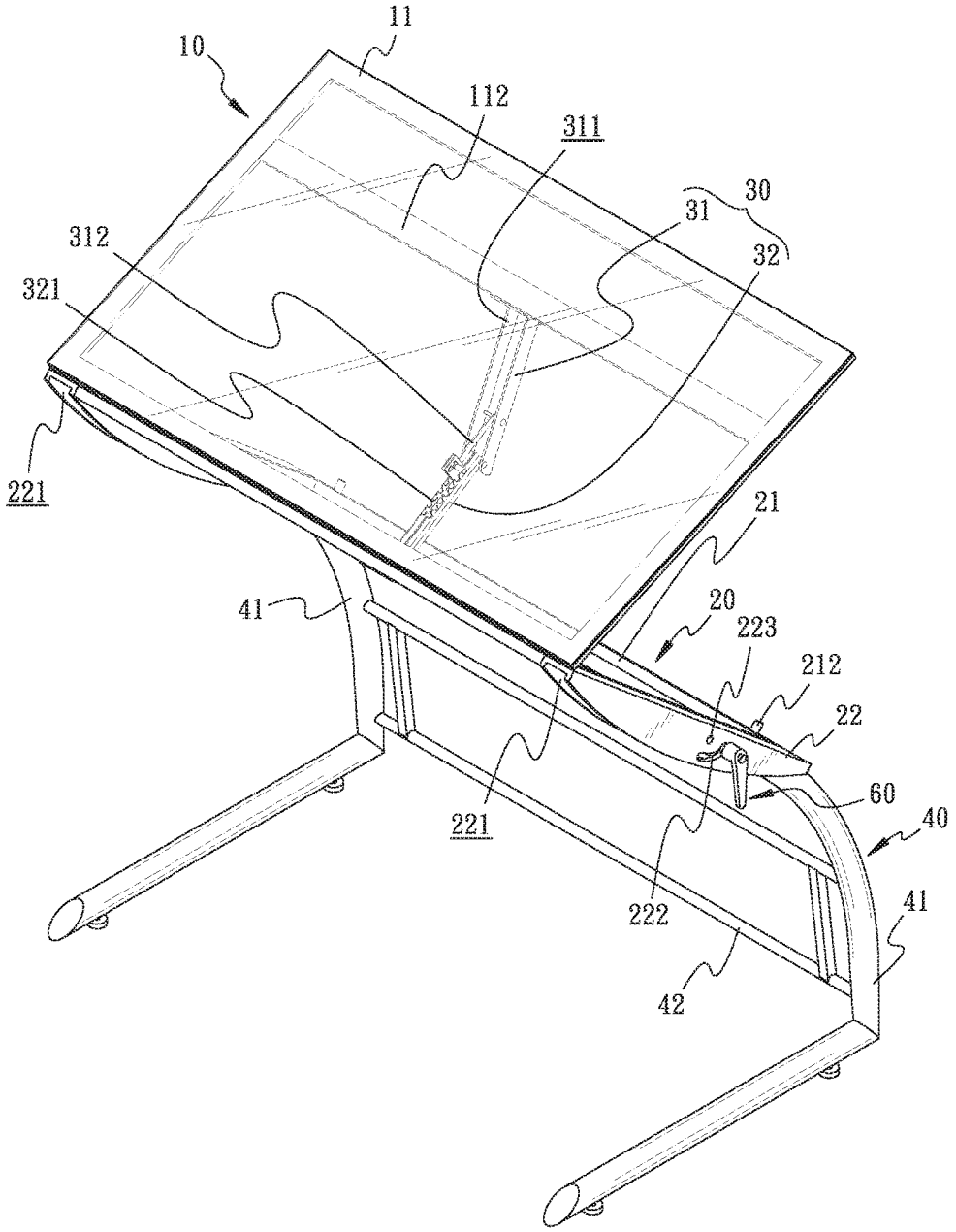
FIG. 6 is another schematic view illustrating the operation status of the adjustable table in accordance with an embodiment of the present invention; the fixed frame inclines downward toward the foot structure.
Figure 7:
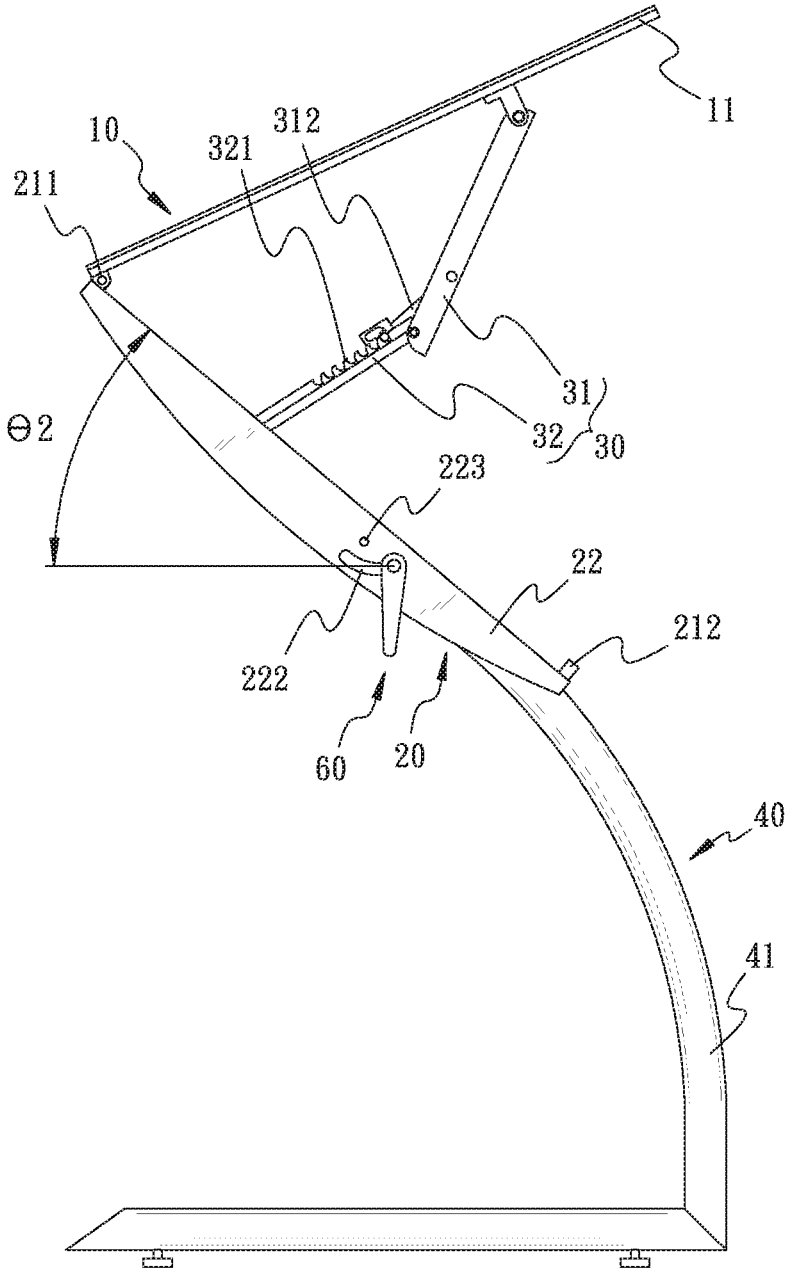
FIG. 7 is a side view of FIG. 6.

The foot structure 40 comprises two hollow foot racks 41 and a connecting rack 42. The connecting rack 42 connects and fixes the two foot racks 41. In an embodiment of the present invention, the two foot racks 41 are tightly received in the recesses 221 of the two inclining racks 22, respectively. Also, each of the two foot rack 41 is provided with a combining bore 411 and a mount hole 412, with a fastening member 70 passing through the combining bore 411 and the corresponding through hole 223 of the inclining structure 20. Therefore, the inclining structure 20 and the foot structure 40 are fastened together, and the two mount holes 412 and the two engaging grooves 222 are pivotally combined by two rotating handles 60, respectively, as shown by FIG. 6 and FIG. 7. With such configuration, the two inclining racks 22 sway toward the foot structure 40, and the inclining structure 20 and the floor include an inclining angle θ2 which is between 0 to 60 degrees. Meanwhile, the table board 10 is allowed to be raised upward further, and the supporting angle θ1 included by the supporting structure 30 is able to be adjusted to 150 degrees, whereby the overall height of the table board 10 is increased against the floor.

With the foregoing configuration, the adjustable table provided by the present invention is allowed to be adjusted according to different users demand. When the user sits, the table board 10 is able to be raised upward to fulfill the comfort for desk or office operation. When the user stands, based on the body height of the user, the inclining structure 20 is adjusted to incline downward toward the foot structure 40, and the overall height of the table is increased, enhancing the utility of the present invention.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An adjustable table, comprising:

a table board with a pivoting portion;

a swaying frame, including a first dispose shaft disposed within, wherein the table board is disposed on the swaying frame;

an inclining structure including a fixed frame pivotally combined with the table board, two inclining racks disposed on two lateral sides of the fixed frame, respectively, and a mounting portion, wherein the fixed frame comprises a second dispose shaft, the mounting portion pivotally connected with the pivoting portion of the table board, such that the table board and the inclining structure are configured to pivotally sway away from and toward each other, so as to open and close with respect to each other;

a supporting structure the supporting structure is pivotally connected to the first dispose shaft of the table board and the second dispose shaft of the fixed frame of the inclining structure for supporting the table board and fixing the table board with respect to the inclining structure; and a foot structure pivotally combined with the inclining structure by connecting to center of each inclining racks, such that the inclining structure is configured to sway toward the foot structure.

2. The adjustable table of claim 1, wherein the supporting structure comprises a supporting shaft and an adjusting shaft, the supporting shaft pivotally connected with the adjusting shaft and the first dispose shaft, and the adjusting shaft pivotally connected with the inclining structure.

3. The adjustable table of claim 2, wherein the supporting shaft includes a dispose groove, a supporting unit is pivotally disposed in the dispose groove, the adjusting shaft is provided with plural tooth-shaped scale units, and the supporting unit engages with different portions of the scale units for supporting the table board at different angles.

4. The adjustable table of claim 1, wherein the supporting structure supports the table board and the inclining structure at different angles, such that the supporting structure includes a supporting angle which is between 30 to 150 degrees.

5. The adjustable table of claim 1, wherein the inclining structure is configured to include an angle relative to a floor surface, and the angle ranges between 0 to 60 degrees.

6. The adjustable table of claim 1, wherein the first dispose shaft is arranged in parallel to the second dispose shaft.

7. The adjustable table of claim 1, wherein two protrusions are disposed on the fixed frame away from the mounting portion, so that the swaying frame is configured to be placed upon the protrusions.

8. The adjustable table of claim 1, wherein the foot structure includes two foot racks, each foot rack provided with a combining bore, each of the two inclining racks provided with an engaging groove, such that the two inclining racks are pivotally combined with the two engaging grooves and the two combining bores by two rotating handles, respectively.

9. The adjustable table of claim 8, wherein the foot structure includes a connecting rack disposed between the two foot racks.

* * * * *